US010413103B1

(12) United States Patent
Balanchi

(10) Patent No.: US 10,413,103 B1
(45) Date of Patent: Sep. 17, 2019

(54) DEVICE TRANSFORMABLE BETWEEN A TOY AND AN EATING UTENSIL

(71) Applicant: Mindscope Products Inc., Glendale, CA (US)

(72) Inventor: George Balanchi, Glendale, CA (US)

(73) Assignee: Mindscope Products Inc., Glendale, CA (US)

( * ) Notice: Subject to any disclaimer, the term of this patent is extended or adjusted under 35 U.S.C. 154(b) by 0 days.

(21) Appl. No.: 16/268,560

(22) Filed: Feb. 6, 2019

(51) Int. Cl.

| | |
|---|---|
| ***A63H 33/16*** | (2006.01) |
| ***A47G 21/02*** | (2006.01) |
| ***A63H 17/26*** | (2006.01) |
| ***A47G 21/04*** | (2006.01) |
| *A47G 21/00* | (2006.01) |

(52) U.S. Cl.
CPC ..... *A47G 21/02* (2013.01); *A47G 21/023* (2013.01); *A47G 21/04* (2013.01); *A63H 17/262* (2013.01); *A47G 2021/002* (2013.01)

(58) Field of Classification Search
CPC ..... A47G 21/02; A63H 17/262
USPC ..... 30/324; D7/642, 655; 446/80
See application file for complete search history.

(56) References Cited

U.S. PATENT DOCUMENTS 2,291,981 A * 8/1942 Neururer ..... A47G 21/04 30/324
D231,721 S * 6/1974 Pearson, Jr. ..... D7/655
3,968,591 A * 7/1976 Pearson, Jr. ..... A47G 21/04 30/324
4,615,120 A * 10/1986 Newman ..... A47G 21/02 16/227
4,779,344 A * 10/1988 Panisch ..... A47G 21/02 30/324
D302,091 S * 7/1989 Bergman ..... D7/655
4,976,646 A * 12/1990 Hull ..... A61J 7/0023 222/78
4,979,258 A * 12/1990 Buj ..... A46B 5/0033 15/143.1
4,993,156 A * 2/1991 Craven ..... A01B 1/22 30/142
5,655,303 A * 8/1997 Janczak ..... A47G 21/02 30/324
5,735,050 A * 4/1998 Hsieh ..... A47G 21/04 30/322
D404,260 S * 1/1999 Lake ..... D7/655
D404,261 S * 1/1999 Lake ..... D7/655
D407,274 S * 3/1999 Lake ..... D7/655
5,940,974 A * 8/1999 Lee ..... A47G 21/02 30/322
5,946,807 A * 9/1999 Crane ..... A47G 21/181 30/141

(Continued)

*Primary Examiner* — Eugene L Kim
*Assistant Examiner* — Matthew B Stanczak
(74) *Attorney, Agent, or Firm* — Kirschstein, Israel, Schiffmiller & Pieroni, P.C.

(57) ABSTRACT

A device is transformable between a toy, such as a vehicle, and an eating utensil, such as a spoon or fork. The device has a movable handle part and a movable head part, both mounted on a toy body for movement between a toy position in which the handle and the head parts both are juxtaposed with the toy body when the device is transformed to the toy, and a utensil position in which the handle and the head parts both extend away from the toy body in opposite directions along a longitudinal axis when the device is transformed to the eating utensil.

16 Claims, 10 Drawing Sheets

(56) References Cited

U.S. PATENT DOCUMENTS

| | | | | | |
|---|---|---|---|---|---|
| 6,237,226 | B1 * | 5/2001 | Huang | A47G 21/02 | 30/322 |
| 6,363,568 | B1 * | 4/2002 | Harrison | A46B 5/00 | 15/167.1 |
| D554,439 | S * | 11/2007 | Malcolm | D7/653 | |
| D554,440 | S * | 11/2007 | Malcolm | D7/653 | |
| D554,441 | S * | 11/2007 | Malcolm | D7/653 | |
| D576,451 | S * | 9/2008 | Bagley, Jr. | D7/655 | |
| D652,269 | S * | 1/2012 | Skolnik | D7/642 | |
| D677,999 | S * | 3/2013 | Skolnik | D7/653 | |
| D716,107 | S * | 10/2014 | Skolnik | D7/401.2 | |
| D728,321 | S * | 5/2015 | Skolnik | D7/642 | |
| D840,769 | S * | 2/2019 | Malcolm | A47G 21/02 | D7/656 |
| 2008/0134520 | A1 * | 6/2008 | Kormandel | B26B 11/008 | 30/142 |
| 2009/0077812 | A1 * | 3/2009 | Malcolm | A47G 21/02 | 30/142 |
| 2009/0144991 | A1 * | 6/2009 | Synnestvedt | A47G 21/02 | 30/324 |
| 2011/0047757 | A1 * | 3/2011 | Zapanta | B25G 1/10 | 16/421 |

* cited by examiner

DEVICE TRANSFORMABLE BETWEEN A TOY AND AN EATING UTENSIL

BACKGROUND

This invention relates to a device transformable between a toy, such as a miniature toy vehicle, and an eating utensil, such as a spoon or fork.

It is known to incorporate an eating utensil, such as a spoon or a fork, with a toy vehicle having wheels, such as a miniature truck, in order to turn a child's mealtime into a fun playtime activity. For example, a parent attempting to feed a child who is being fussy with food may wish to divert the child's attention by directing the child's attention to the toy vehicle on the utensil. Also, the wheels of the toy vehicle may be rolled or slid along the top surface of a plate, a table, or a highchair tray to push the food around in the nature of a game to encourage the fussy child to have fun and eat the food.

However, once mealtime is completed, playtime with the utensil is over, because the utensil cannot be safely used as a toy. The child cannot safely play with the toy vehicle, because certain parts of the utensil, e.g., the handle, the fork's tines, the spoon's bowl, etc., extend constantly outwardly of the toy vehicle and are permanently fixed in their extended positions. These constantly exposed utensil parts represent a safety hazard. Children, especially unsupervised youngsters, may be injured by poking themselves or others with such exposed utensil parts, especially so in the case of a fork's tines that are pointed.

Accordingly, it is desirable to provide a device that is easy to manipulate and transform from an eating utensil to a toy in order to extend a child's safe playtime activity, and to easily manipulate and transform the device back again to an eating utensil in order to enhance playtime activity at mealtime. It is further desirable to provide such a device that is simple in construction, inexpensive to manufacture, compact, ornamental in appearance, and durable and safe in use.

BRIEF DESCRIPTION OF THE FIGURES

The accompanying figures, where like reference numerals refer to identical or functionally similar components throughout the separate views, together with the detailed description below, are incorporated in and form part of the specification, and serve to further illustrate embodiments of concepts that include the claimed invention, and explain various principles and advantages of those embodiments.

DETAILED DESCRIPTION

Figure 1:
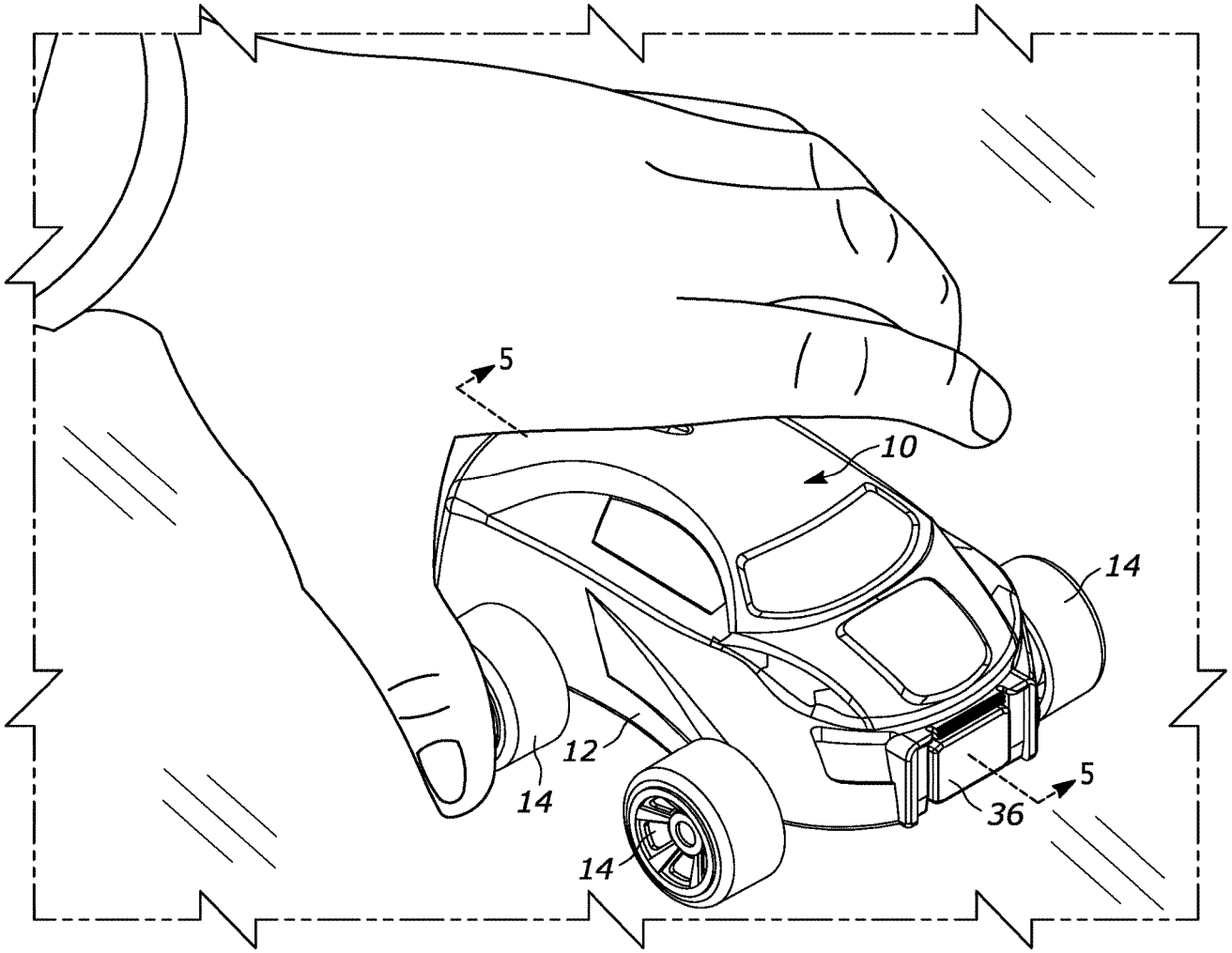
FIG. 1 is an overhead perspective view of a device in accordance with this disclosure after being transformed into a toy.

Referring now to the drawings, reference numeral 10 identifies a device convertible or transformable, as described below, between a toy (see FIG. 1) and an eating utensil (see FIGS. 2-3). As illustrated in FIG. 1, the toy has a toy body 12 configured as a miniature toy vehicle resembling an automobile or car having a set of wheels 14. The toy body 12 extends lengthwise along a longitudinal axis and has a length on the order of 3½ inches. The toy body 12 has a rear opening 38 located generally where a rear license plate would be situated, and a front opening 40 located generally where a front license plate would be situated. The wheels 14 are preferably mounted for turning movement on the toy body 12, but may alternatively be fixed thereon.

It will be understood that this invention is not intended to be limited to the illustrated car, because many other types of vehicles and other types of toys are contemplated by this disclosure. For example, rather than a simulated car, such as a taxi or a police car (non-illustrated graphics and/or text may be applied over the toy body 12 to complete the simulation), the toy could be configured as a construction machine, such as a bulldozer, a forklift truck, a front loader, etc. The toy could also be configured as other vehicles, such as a train car, an airplane, a truck, a bus, a wagon, a bicycle, etc. In addition, the toy need not have wheels and could be configured as a boat, a sled, a spaceship, a helicopter, etc. Rather than vehicles, any other type of toy, such as a robot, a figurine, an animal, etc., may also be configured by the toy body 12.

Figure 2:
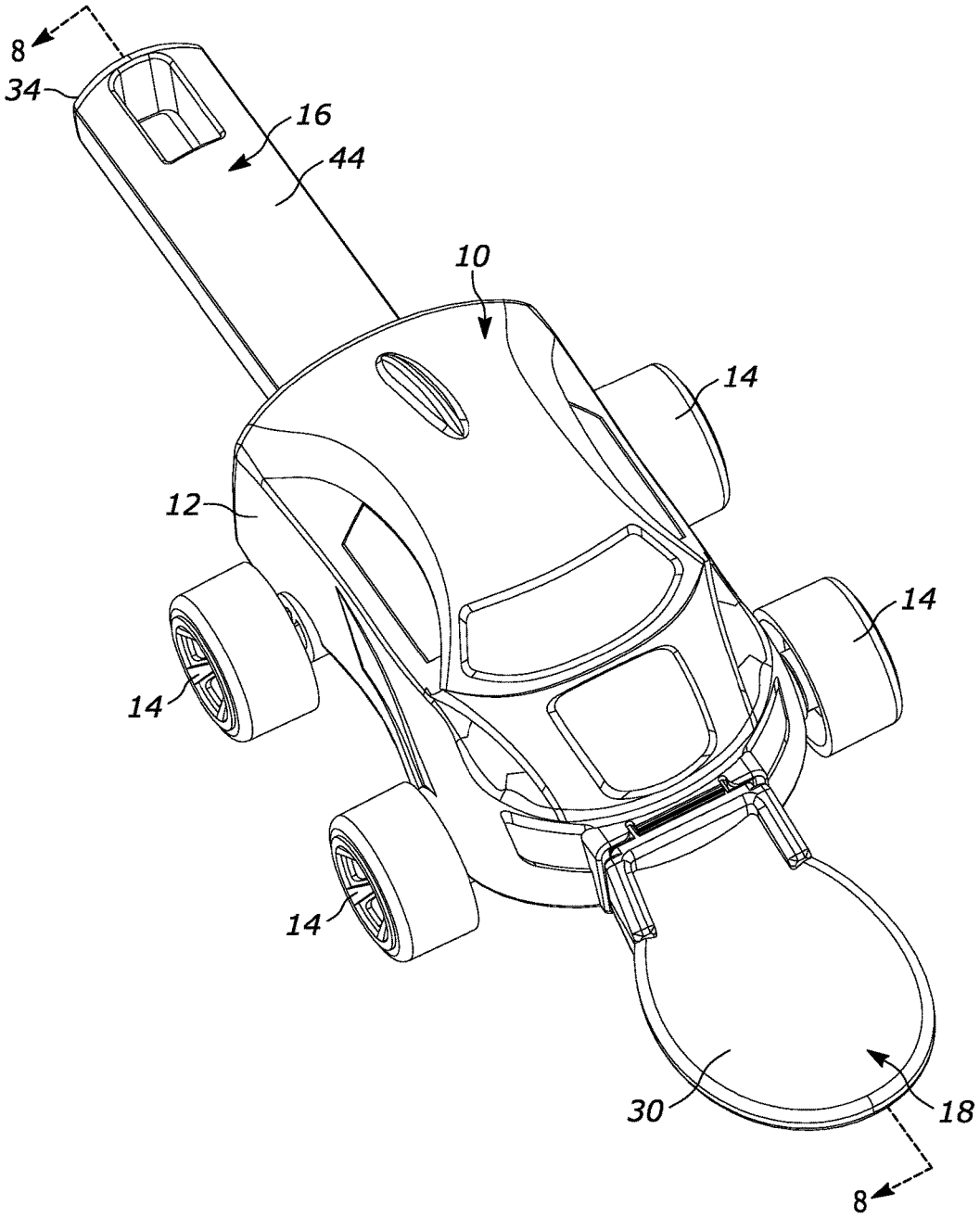
FIG. 2 is an overhead perspective view of the device of FIG. 1 after being transformed into an eating utensil configured as a spoon.
Figure 3:
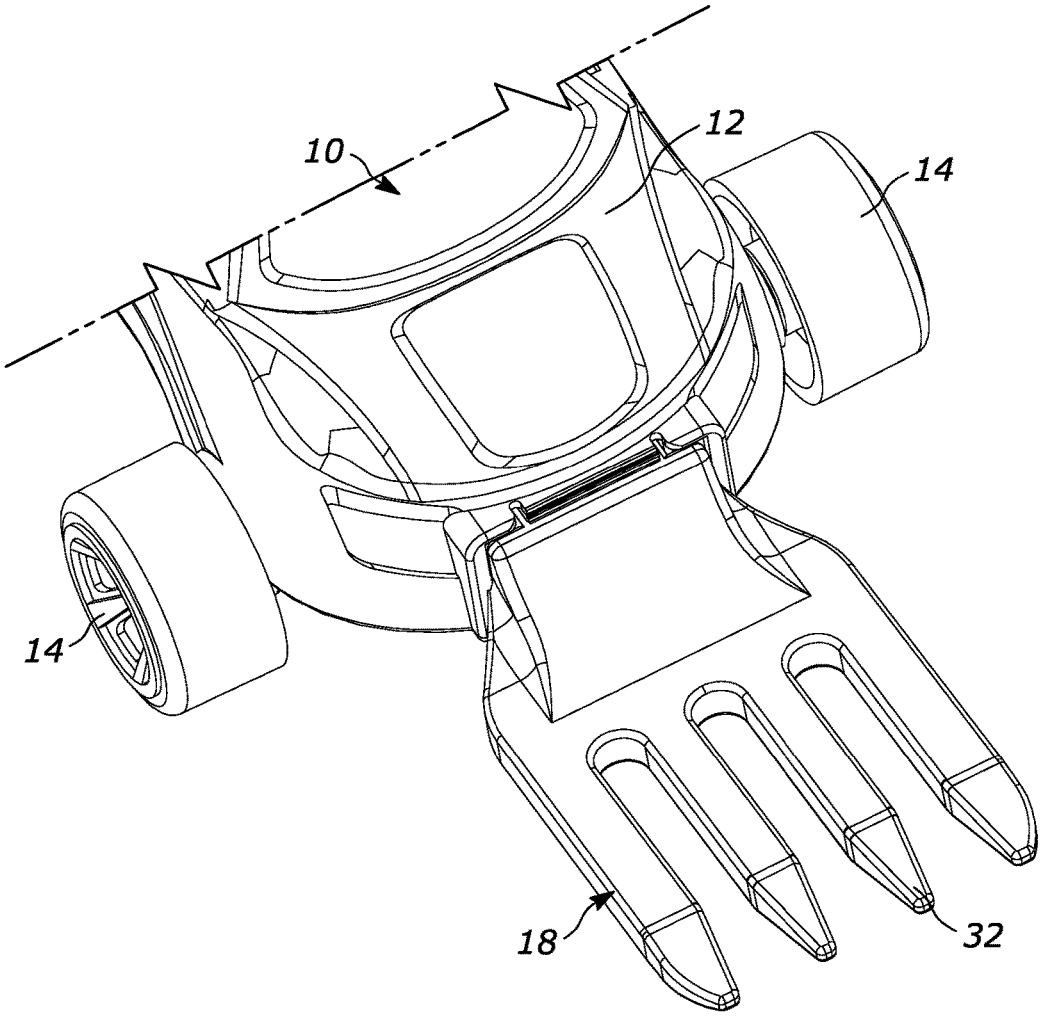
FIG. 3 is a broken-away view analogous to FIG. 2 after the device has been transformed into an eating utensil configured as a fork.

As illustrated in FIG. 2, the eating utensil may be configured as a spoon having a spoon bowl 30, or as a fork having tines 32 as shown in FIG. 3. It will be understood that this invention is also not intended to be limited to the illustrated fork and spoon, because other types of utensils, such a knife or a combination utensil, such as a spork (spoon and fork), are also contemplated by this disclosure.

The eating utensil includes, as shown in FIG. 2, a handle part 16 and a head part 18, both mounted on the toy body 12 for movement, as described below, between a toy position (FIGS. 1, 4 and 5) and a utensil position (FIGS. 2-3, 6-8 and 10). In the toy position, the handle part 16 and the head part 18 are at least partially, and preferably fully, covered and concealed by the toy body 12, and are securely held and locked in their covered positions, as described below, in order to allow a child to safely interact and play with the toy without being exposed as in the prior art to any constantly exposed parts of the utensil. In the utensil position, the handle part 16 and the head part 18 both extend away from the toy body 12 in opposite directions collinearly along the longitudinal axis, and are securely held and locked in their extended positions, as described below, in order to allow the utensil to be used for eating food.

The handle part 16 is elongated lengthwise along the longitudinal axis and has a length extending between a rear end 34 and a front end 36. Preferably, the handle part 16 has a smooth upper surface 44, and has interior portions thereof removed and open on its opposite lower surface to save on weight and manufacturing cost and to increase its strength and rigidity.

Figure 4:
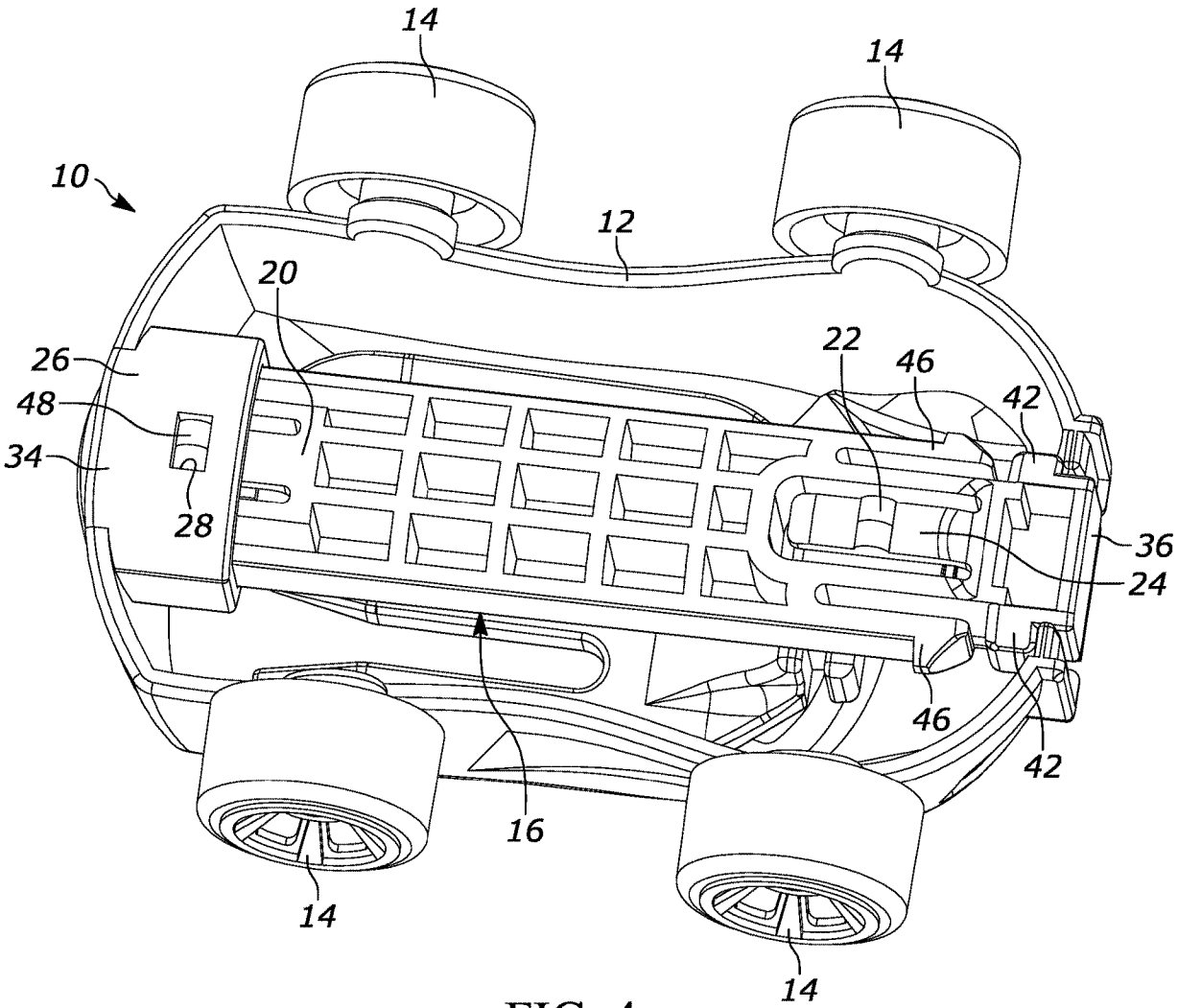
FIG. 4 is a bottom perspective view of the device of FIG. 1.
Figure 5:
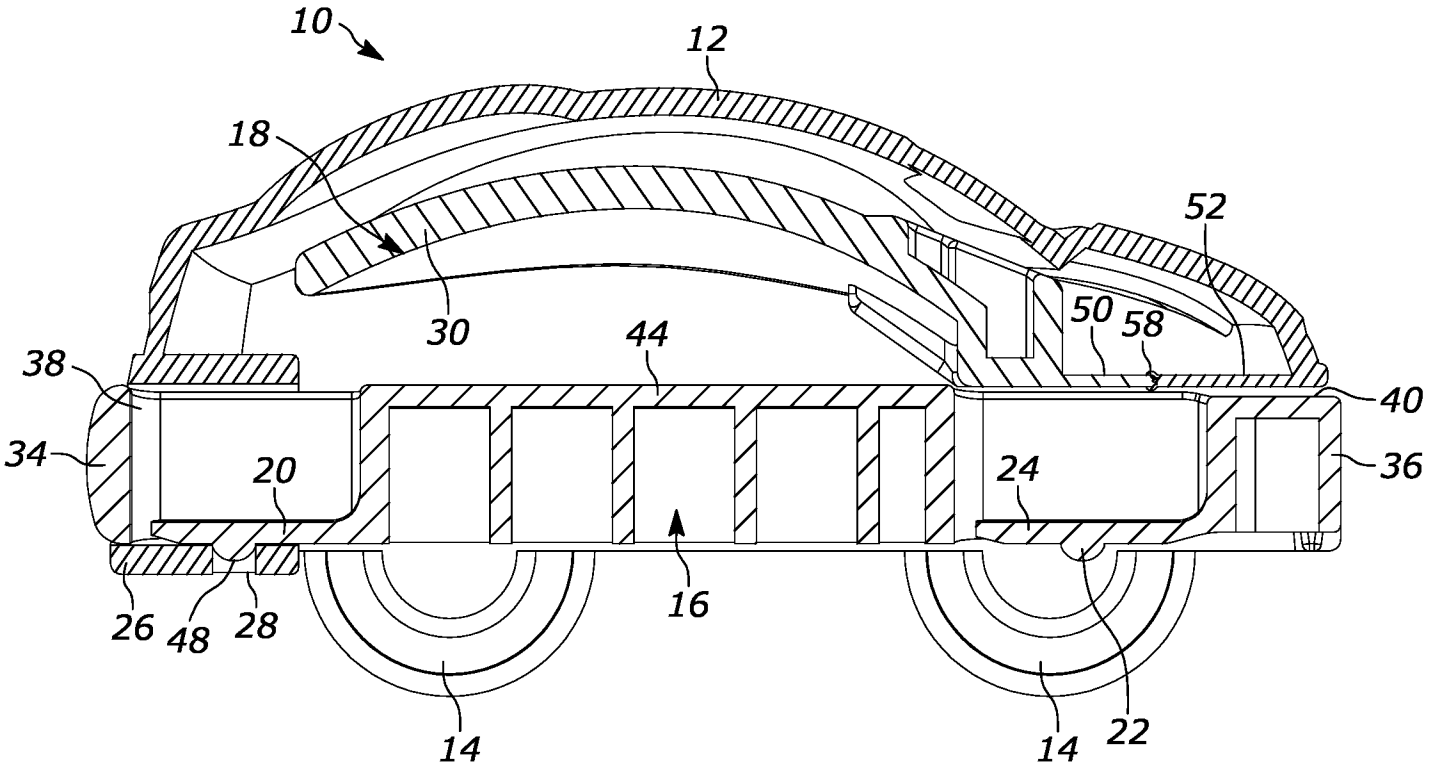
FIG. 5 is a sectional view taken along the line 5-5 of FIG. 1.

In the toy position, the handle part 16 and the head part 18 are both juxtaposed with each other in close confronting adjacent relationship underneath and within the toy body 12, with the handle part 16 being situated outwardly of, and below, the head part 18, as best shown in FIGS. 4-5. The length of the handle part 16 generally corresponds to the length of the toy body 12. As shown in the toy position of FIGS. 4-5, the rear end 34 of the handle part 16 is located in the rear opening 38 of the car body 12 to simulate a rear license plate, or may extend slightly past the rear opening 38 to simulate a rear bumper. As also shown in the toy position of FIGS. 4-5, the front end 36 of the handle part 16 is located in the front opening 40 of the car body 12 to simulate a front license plate, or may extend slightly past the front opening 40 to simulate a front bumper. The front end 36 of the handle part 16 has a pair of stops 42 that abut against the interior walls of the car body 12 that bound the front opening 40 to help the handle part 16 assume and maintain the toy position.

As best seen in FIGS. 4-8, in one embodiment, the handle part 16 is mounted for sliding movement on, and underneath, the toy body 12 along the longitudinal axis. The handle part 16 is preferably constituted of a resilient material, such as plastic, and has a first bump or locking projection 48 on, and protruding away from, a resilient, elongated, cantilevered arm 20 at a rear end portion of the handle part 16, and a second bump or locking projection 22 on, and protruding away from, another resilient, elongated, cantilevered arm 24 at an opposite front end portion of the handle part 16. Each resilient arm 20, 24 extends lengthwise of the longitudinal axis in an original, normal, relaxed position.

The toy body 12 has an integrally formed, hollow, annular, slide collar 26, in which the handle part 16 closely fits and slides along the longitudinal axis, at a rear end region of the toy body 12. The slide collar 26 has a sidewall bounding an opening or recess 28 extending therethrough. During this sliding movement, when the respective projections 48, 22 overlie the sidewall of the slide collar 26, then the respective projections 48, 22 deflect and push the respective resilient arms 20, 24 to stressed bent positions away from their respective original relaxed positions, in which they extend along the longitudinal axis, inwardly into the handle part 16. During this sliding movement, when the respective projections 48, 22 overlie the recess 28, then the respective projections 18, 22 enter the recess 28, and the respective resilient arms 20, 24 return towards their original relaxed positions due to their inherent resilience.

Figure 6:
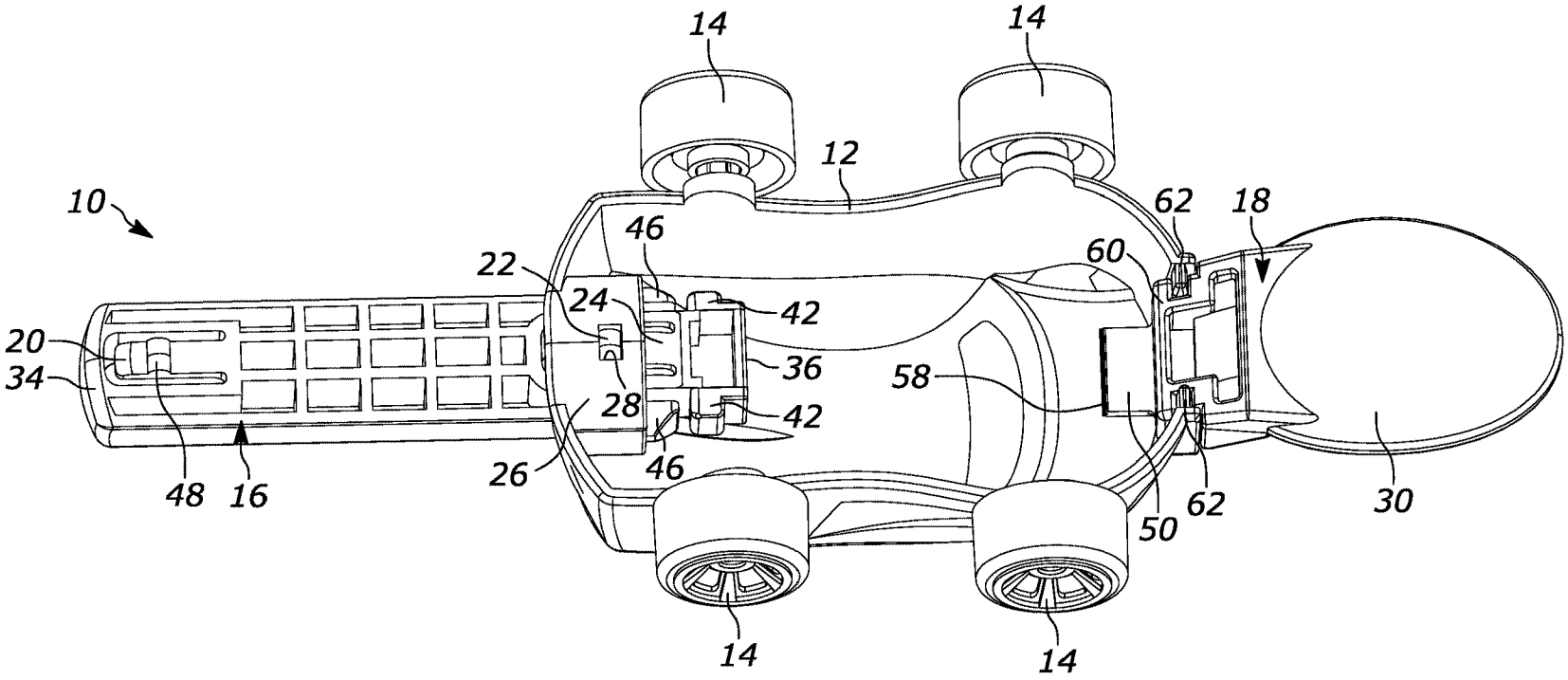
FIG. 6 is a bottom perspective view of the device of FIG. 1 after being transformed into the eating utensil of FIG. 2.
Figure 7:
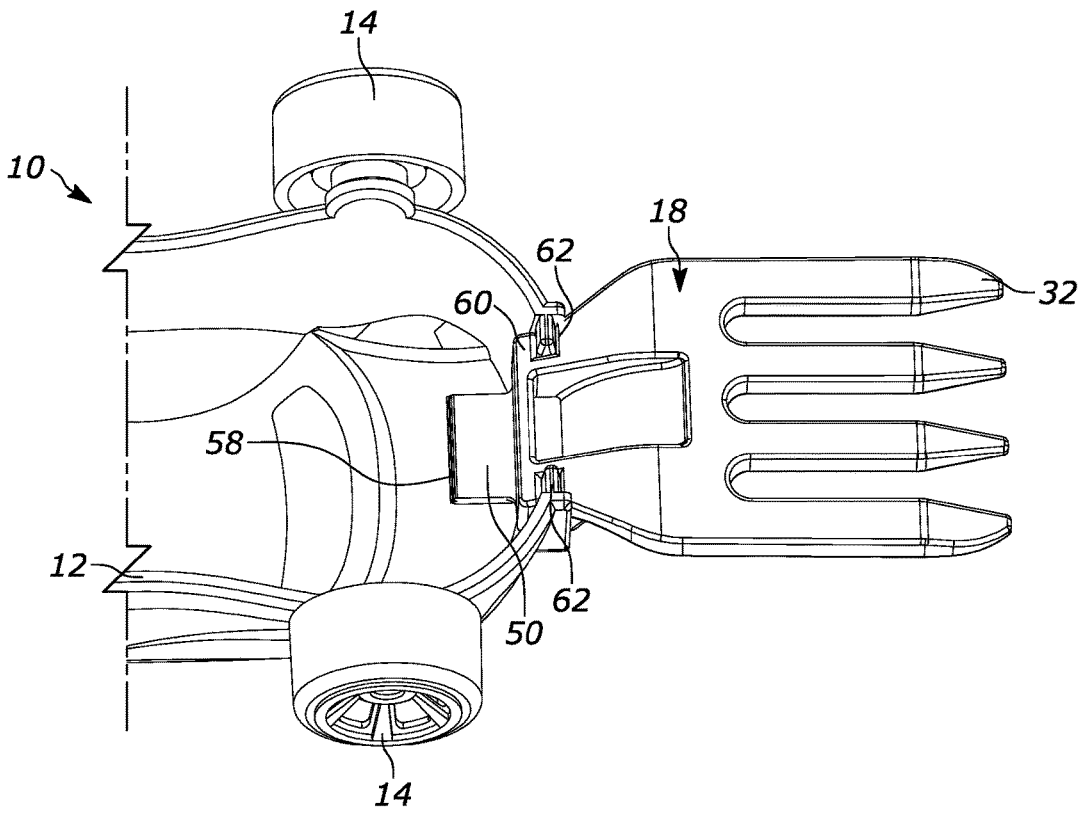
FIG. 7 is a broken-away view analogous to FIG. 6 after the device has been transformed into the eating utensil of FIG. 3.
Figure 8:
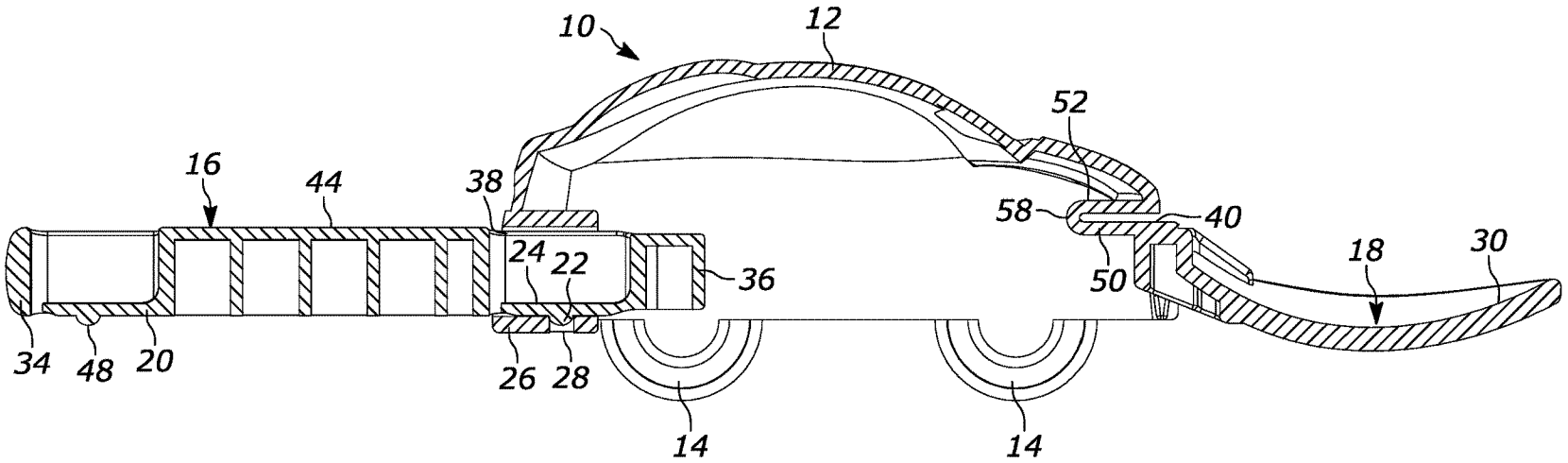
FIG. 8 is a sectional view taken along the line 8-8 of FIG. 2.
Figure 10:
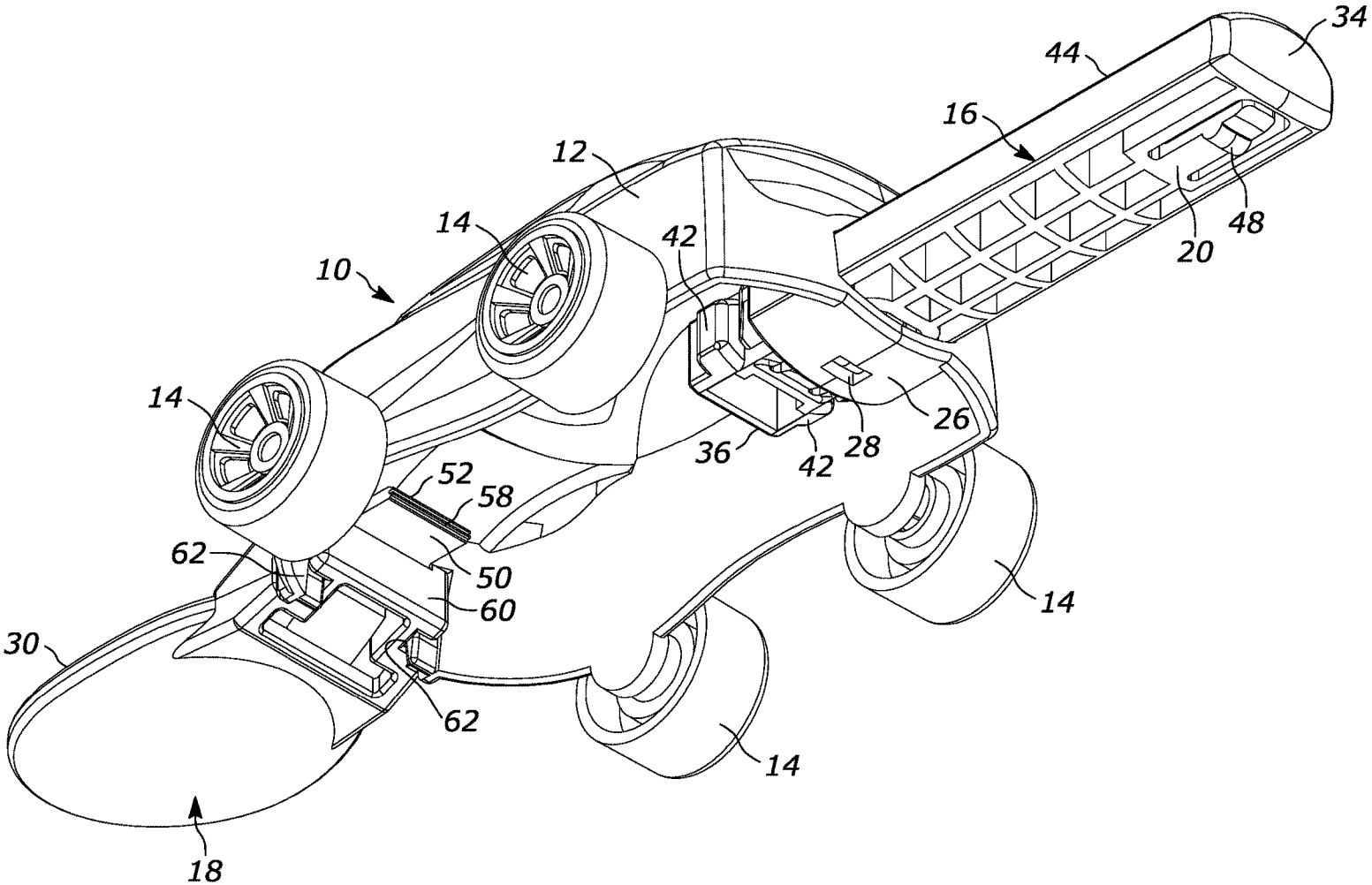
FIG. 10 is a bottom perspective view of the device of FIG. 1 after being transformed into the eating utensil of FIG. 2.

As shown in FIGS. 4-5, the first locking projection 418 is received with a snap-type action in the recess 28 due to the resilience of the resilient arm 20 in order to hold and lock the handle part 16 in its covered toy position. As shown in FIGS. 6, 8 and 10, after the handle part 16 has been slid rearwardly of the toy body 12, the second locking projection 22 is received with a snap-type action in the recess 28 due to the resilience of the resilient arm 24 in order to hold and lock the handle part 16 in its extended utensil position. The front end 36 of the handle part 16 also has a pair of stops 46 that abut against the side walls of the slide collar 26 to help the handle part 16 assume and maintain the utensil position. Manually depressing the respective resilient arms 20, 24 until the respective projections 48, 22 clear and exit the recess 28, and/or exerting manual pressure along the longitudinal axis until the respective projections 48, 22 are forced out of the recess 28, will release the handle part 16 from its respective locked positions.

Figure 9:
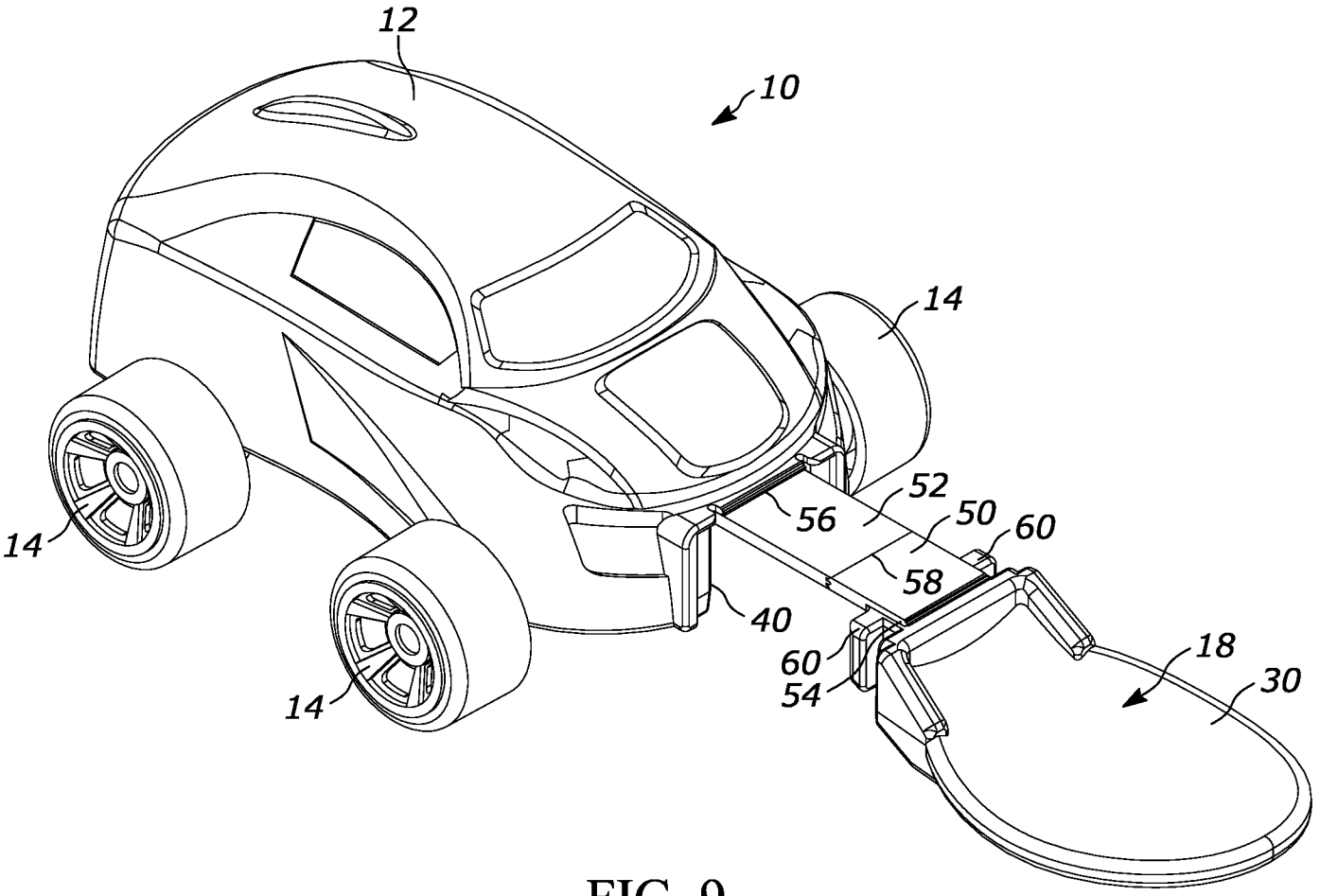
FIG. 9 is an overhead perspective view of the device of FIG. 1 during conversion to the eating utensil of FIG. 2.

As best shown in FIG. 9, the head part 18 is mounted on the toy body 12 by a pair of hinge plates 50, 52. Plate 50 is pivotably connected to the head part 18 along a hinge or pivot axis 54; plate 52 is pivotably connected to the toy body 12 along a hinge or pivot axis 56; and the plates 50, 52 are pivotably connected to each along a hinge or pivot axis 58. Each pivot axis 54, 56, 58 extends transversely of, and is perpendicular to, the longitudinal axis.

As best shown in the toy position of FIG. 5, the head part 18 is rearwardly pivoted about the pivot axes 54, 56, 58 until it is located deep within the toy body 12, and then the handle part 16 is slid forwardly below the head part 18, thereby securing the head part 18 in its covered toy position. In the toy position, the hinge plates 50, 52 are generally coplanar and are located above the handle part 16.

When it is desired to convert the device to the utensil position, then the handle part 16 is moved rearwardly, and the head part 16 is forwardly pivoted about the pivot axes 54, 56, 58. The head part 18 has a stem portion 60 that has a pair of side grooves 62. The head part 16 is then moved upwardly in a vertical direction perpendicular to the longitudinal axis until the side portions bounding the front opening 40 of the toy body 12 are snugly received with a friction-tight action in the side grooves 62, thereby securing the head part 18 in its utensil position. In the utensil position, the hinge plates 50, 52 generally overlie each other within the toy body 12, as best shown in FIG. 8.

It will be understood that each of the components described above, or two or more together, also may find a useful application in other types of constructions differing from the types described above.

While the invention has been illustrated and described as embodied in a device transformable between a toy and an eating utensil, it is not intended to be limited to the details shown, since various modifications and structural changes may be made without departing in any way from the spirit of the present invention.

For example, the handle part 16 need not be slidable between the toy position and the utensil position as described above, but could be mounted for pivoting movement between the toy position and the utensil position. Alternatively, the handle part 16 may be completely removable from the toy body 12 in the toy position, and then be assembled back on the toy body 12 in the utensil position. Analogously, the head part 18 need not be mounted for pivoting movement on the toy body 12 as described above, but may be slidable between the toy position and the utensil position, or may be completely removable from the toy body 12 in the toy position, and then be assembled back on the toy body 12 in the utensil position. In variant constructions, the handle part 16 and/or the head part 18 may overlie the toy body 12 in the toy position.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A device transformable between a toy and an eating utensil, the device comprising:

a toy body having a top and a bottom; and a movable handle part and a movable head part, both mounted on the toy body for movement between a toy position in which the handle part and the head part both are juxtaposed with the toy body when the device is transformed to the toy, and a utensil position in which the handle part and the head part both extend away from the toy body in opposite directions along a longitudinal axis when the device is transformed to the eating utensil, the head part being more proximate than the handle part to the top of the toy body, the handle part being more proximate than the head part to the bottom of the toy body, the handle part lying underneath the head part to secure the head part in the toy position.

2. The device of claim 1, wherein the toy body has a vehicle shape, and has a set of wheels mounted on the toy body.

3. The device of claim 1, wherein the toy body has opposite end regions spaced apart along the longitudinal axis, and wherein the handle part extends past one of the end regions in the utensil position, and wherein the head part extends past the other of the end regions in the utensil position.

4. The device of claim 1, wherein the handle part and the head part both lie underneath, and are at least partially covered by, the toy body in the toy position.

5. The device of claim 1, wherein the handle part and the head part both lie in close confronting relationship adjacent each other in the toy position.

6. The device of claim 1, wherein the handle part is elongated along the longitudinal axis and is mounted for sliding movement relative to the toy body along the longitudinal axis.

7. The device of claim 1, wherein the handle part has one lock for locking the handle part in the toy position, and another lock for locking the handle part in the utensil position.

8. The device of claim 7, wherein the toy body has a slide collar having a recess, wherein the handle part is mounted for sliding movement within the slide collar, wherein the one lock is a projection received with snap action in the recess in the toy position, and wherein the other lock is another projection received with snap action in the recess in the utensil position.

9. The device of claim 1, wherein the handle part has one stop for stopping the handle part in the toy position, and another stop for stopping the handle part in the utensil position.

10. The device of claim 1, wherein the head part is mounted for pivoting movement on the toy body about a transverse axis perpendicular to the longitudinal axis.

11. The device of claim 10, wherein the head part is pivotably connected to the toy body with a pair of hinge plates, and wherein the hinge plates are generally coplanar in the toy position and generally overlap each other in the utensil position.

12. The device of claim 10, wherein the head part has a stem with side grooves that snugly receive the toy body in the utensil position.

13. The device of claim 1, wherein the head part has fork tines.

14. The device of claim 1, wherein the head part has a spoon bowl.

15. A device transformable between a toy and an eating utensil, the device comprising:

a toy body having opposite openings spaced apart along a longitudinal axis; and a movable handle part and a movable head part, both mounted on the toy body for movement between a toy position in which the handle part and the head part both are juxtaposed with the toy body when the device is transformed to the toy, and a utensil position in which the handle part and the head part both extend away from the toy body in opposite directions along the longitudinal axis when the device is transformed to the eating utensil, the handle part having opposite ends respectively received in the openings in the toy position.

16. A device transformable between a toy and an eating utensil, the device comprising:

a toy body having a slide collar with a recess; and a movable handle part and a movable head part, both mounted on the toy body for movement between a toy position in which the handle part and the head part both are juxtaposed with the toy body when the device is transformed to the toy, and a utensil position in which the handle part and the head part both extend away from the toy body in opposite directions along a longitudinal axis when the device is transformed to the eating utensil, the handle part having one lock for locking the handle part in the toy position, and another lock for locking the handle part in the utensil position, the handle part being mounted for sliding movement within the slide collar, the one lock being a projection received with snap action in the recess in the toy position, and the other lock being another projection received with snap action in the recess in the utensil position, the handle part having a pair of cantilevered arms, and the projections being respectively located on the arms.

* * * * *